US007837191B2

(12) United States Patent
Katou et al.

(10) Patent No.: US 7,837,191 B2
(45) Date of Patent: Nov. 23, 2010

(54) SHEET CARRYING STATE DETERMINING DEVICE AND SHEET CARRYING STATE DETERMINING METHOD

(75) Inventors: Hiroyo Katou, Shizuoka-ken (JP); Yoshikatsu Kamisuwa, Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 98 days.

(21) Appl. No.: 12/124,704

(22) Filed: May 21, 2008

(65) Prior Publication Data

US 2009/0057992 A1 Mar. 5, 2009

Related U.S. Application Data

(60) Provisional application No. 60/969,140, filed on Aug. 30, 2007.

(51) Int. Cl.
*B65H 7/02* (2006.01)

(52) U.S. Cl. ..... 271/228; 271/265.02; 271/265.01; 271/265.03; 271/227

(58) Field of Classification Search ..... 271/227, 271/228, 265.01–265.03
See application file for complete search history.

(56) References Cited

U.S. PATENT DOCUMENTS

| | | | | | |
|---|---|---|---|---|---|
| 4,971,304 | A * | 11/1990 | Lofthus | 271/227 |
| 5,169,140 | A * | 12/1992 | Wenthe, Jr. | 271/228 |
| 5,278,624 | A * | 1/1994 | Kamprath et al. | 399/395 |
| 5,322,273 | A * | 6/1994 | Rapkin et al. | 271/227 |
| 5,533,721 | A * | 7/1996 | Takashimizu | 271/109 |
| 5,678,159 | A * | 10/1997 | Williams et al. | 399/395 |
| 5,697,608 | A * | 12/1997 | Castelli et al. | 271/228 |
| 6,988,725 | B2 * | 1/2006 | Rapkin | 271/227 |
| 7,322,575 | B2 * | 1/2008 | Sauer et al. | 271/234 |
| 7,422,210 | B2 * | 9/2008 | Dejong et al. | 271/228 |
| 2008/0240820 | A1 * | 10/2008 | deJong et al. | 399/395 |

* cited by examiner

*Primary Examiner*—Kaitlin S Joerger
(74) *Attorney, Agent, or Firm*—Patterson & Sheridan, LLP

(57) ABSTRACT

A technique is provided that enables detection of the state of a sheet skew or the like without adding a special sensor or the like in a sheet carrying apparatus if possible. Information about sheet detection timing by two sensors that are arranged at different positions from each other in a sheet carrying direction and arranged at positions different from each other in a direction orthogonal to the sheet carrying direction is acquired. A skew of a carried sheet is determined in accordance with the acquired information.

18 Claims, 13 Drawing Sheets

SHEET CARRYING STATE DETERMINING DEVICE AND SHEET CARRYING STATE DETERMINING METHOD

BACKGROUND OF THE INVENTION

1. Field of the Invention

The present invention relates to a technique of realizing skew detection of a sheet with a simple configuration, in a sheet carrying apparatus that carries a sheet.

2. Description of the Related Art

Conventionally, a technique of detecting a paper jam by using plural sensors arranged on a sheet carrying path in a sheet carrying apparatus that carries a sheet has been known. The plural sensors arranged as described above detect passage timing of the forward edge or rear edge of a sheet carried along the carrying path. When this passage timing has exceeded a preset allowable limit value, it is determined that sheet clogging (so-called a jam) has occurred.

In order to detect a skew (slanting) of a sheet, there is also a known technique of arraying plural sensors in a direction orthogonal to the carrying direction (see FIG. 9), then measuring the difference in passage timing between the sensors, and thereby determining the skew (for example, see JP-A-10-53355).

There is also a known technique of detecting the time for the forward edge of a sheet to pass between a sensor that detects passage of the sheet and an edge sensor that detects a lateral shift of the sheet, then comparing this time with the passage time in the same sensor section in a normal state (without a skew), and detecting the quantity of skew from the result of the comparison (JP-A-2005-350155).

However, in the technique described in JP-A-10-53355, since the plural sensors must be arrayed in a direction orthogonal to the carrying direction in order to detect the skew of a sheet, there is a problem that the number of sensors in the entire apparatus is increased.

Meanwhile, in the technique described in JP-A-2005-350155, since the edge sensor is used to detect the quantity of skew, there is a problem that the quantity of skew changes depending on the sheet size in the lateral direction (sheet width). Recently, the miniaturization of the apparatus causes reduction in the length of the carrying path and increase in the sheet carrying speed. Therefore, there may be inconvenience with the edge sensor that has limitations in its installation conditions, for example, a predetermined spacing to the registration roller is required in the carrying direction.

Moreover, in the technique described in JP-A-2005-350155, if the carrying time is changed by wear of a roller or the like, the carrying time of a sheet to be a detection target is influenced by the change in the carrying time due to the roller and the quantity of skew cannot be accurately determined.

SUMMARY OF THE INVENTION

It is an object of an embodiment of the invention to provide a technique that enables detection of the state of a sheet skew or the like without adding a special sensor or the like in the sheet carrying apparatus if possible.

To solve the above problems, a sheet carrying state determining device according to an aspect of the invention includes: a detection information acquiring unit configured to acquire information about sheet detection timing by two sensors that are arranged at different positions from each other in a sheet carrying direction and arranged at positions different from each other in a direction orthogonal to the sheet carrying direction; and a determining unit configured to determine a skew of a carried sheet in accordance with the information acquired by the detection information acquiring unit.

A sheet carrying state determining method according to another aspect of the invention includes: acquiring information about sheet detection timing by two sensors that are arranged at different positions from each other in a sheet carrying direction and arranged at positions different from each other in a direction orthogonal to the sheet carrying direction; and determining a skew of a carried sheet in accordance with the acquired information.

DESCRIPTION OF THE EMBODIMENTS

Hereinafter, embodiments of the invention will be described with reference to the drawings.

First, an image forming apparatus having a sheet carrying state determining device according to an embodiment of the invention will be described.

Figure 1:
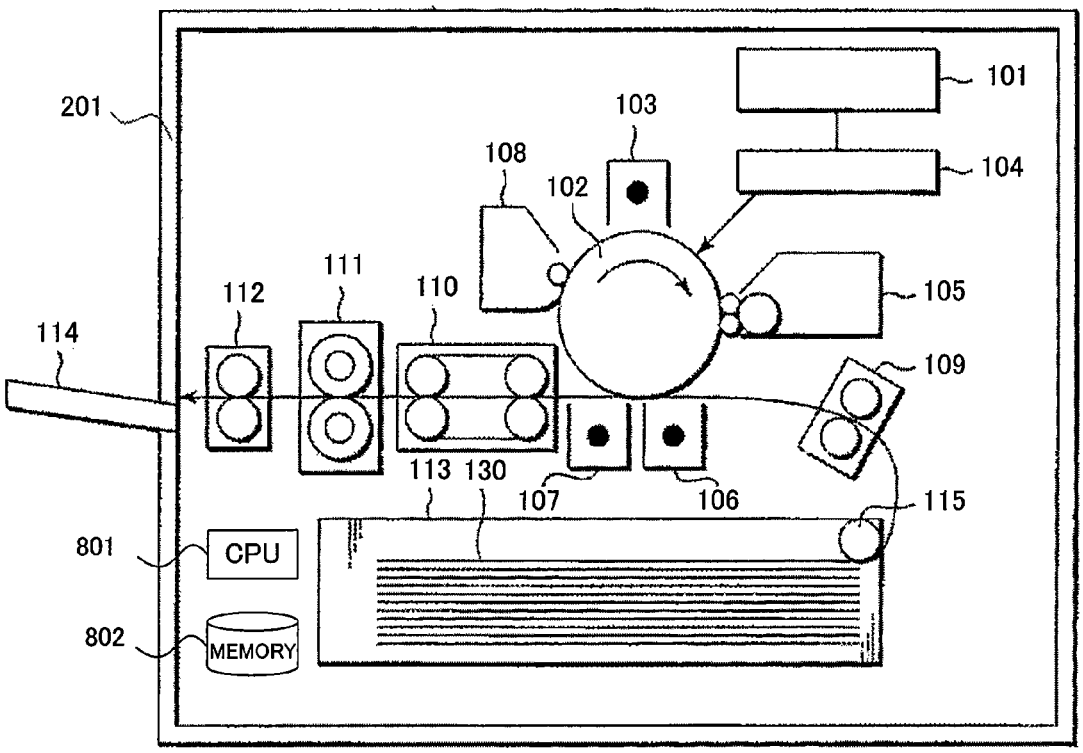
FIG. 1 is a view for explaining an overall configuration of an image forming apparatus (multi-function peripheral or MFP) according to an embodiment of the invention.

FIG. 1 is a view for explaining an overall configuration of an image forming apparatus (multi-function peripheral or MFP) according to the embodiment of the invention.

Specifically, an image forming apparatus 201 has a control unit 101, a photoconductive drum 102, a charging unit 103, a scanning exposure unit 104, a developing unit 105, a transfer charger 106, a stripping charger 107, a cleaner 108, a paper feeding unit 109, a sheet carrying unit 110, a fixing unit 111, a paper discharge unit 112, a cassette 113, a paper discharge tray 114, a paper feeding roller 115, a CPU 801 and a memory 802.

The photoconductive drum 102 has its photoconductive surface turn in a sub scanning direction (the circumferential direction of the photoconductive drum 102). In the vicinity of the photoconductive surface of the photoconductive drum 102, first, the charging unit 103 is arranged. The charging unit 103 uniformly charges the surface of the photoconductive drum 102.

The scanning exposure unit 104 emits light or turns off in accordance with an image signal while scanning with a semiconductor laser, not shown, provided in the scanning exposure unit 104. A laser beam emitted from this semiconductor laser is turned into light that scans in a main scanning direction (the direction parallel to the rotation axis of the photoconductive drum 102) by a deflector such as a polygon mirror.

The laser beam is cast onto the photoconductive drum 102 by an optical system including lenses and so on. As the laser beam is cast onto the charged photoconductive surface of the photoconductive drum 102, the potential at the irradiated part is lowered and an electrostatic latent image is formed there.

The developing unit 105 applies a developer to the photoconductive drum 102 and thus forms a developer image on the photoconductive drum 102.

The cassette 113 is provided in the bottom part of the image forming apparatus 201. The paper feeding roller 115 separates sheets 130 in the cassette 113 one by one and send each sheet to the paper feeding unit 109. The paper feeding unit 109 supplies sheet 130 to a transfer position on the photoconductive drum 102. The transfer charger 106 transfers the developer image to the supplied sheet 130. The stripping charger 107 strips the sheet 130 from the photoconductive drum 102.

The sheet 130 with the developer image transferred thereto is carried to the fixing unit 111 by the sheet carrying unit 110. The fixing unit 111 fixes by heating the developer image transferred onto the sheet 130, to the sheet 130. The paper discharge unit 112 discharges the sheet 130 with the image printed thereon onto the discharge tray 114.

After the transfer of the developer image to the sheet 130 is finished, the developer remaining on the photoconductive drum 102 is removed by the cleaner 108. The photoconductive drum 102 restores its initial state and enters a standby state for the next image forming processing.

As the above process operation is repeated, the image forming operation in the image forming apparatus 201 is continuously carried out.

Figure 2:
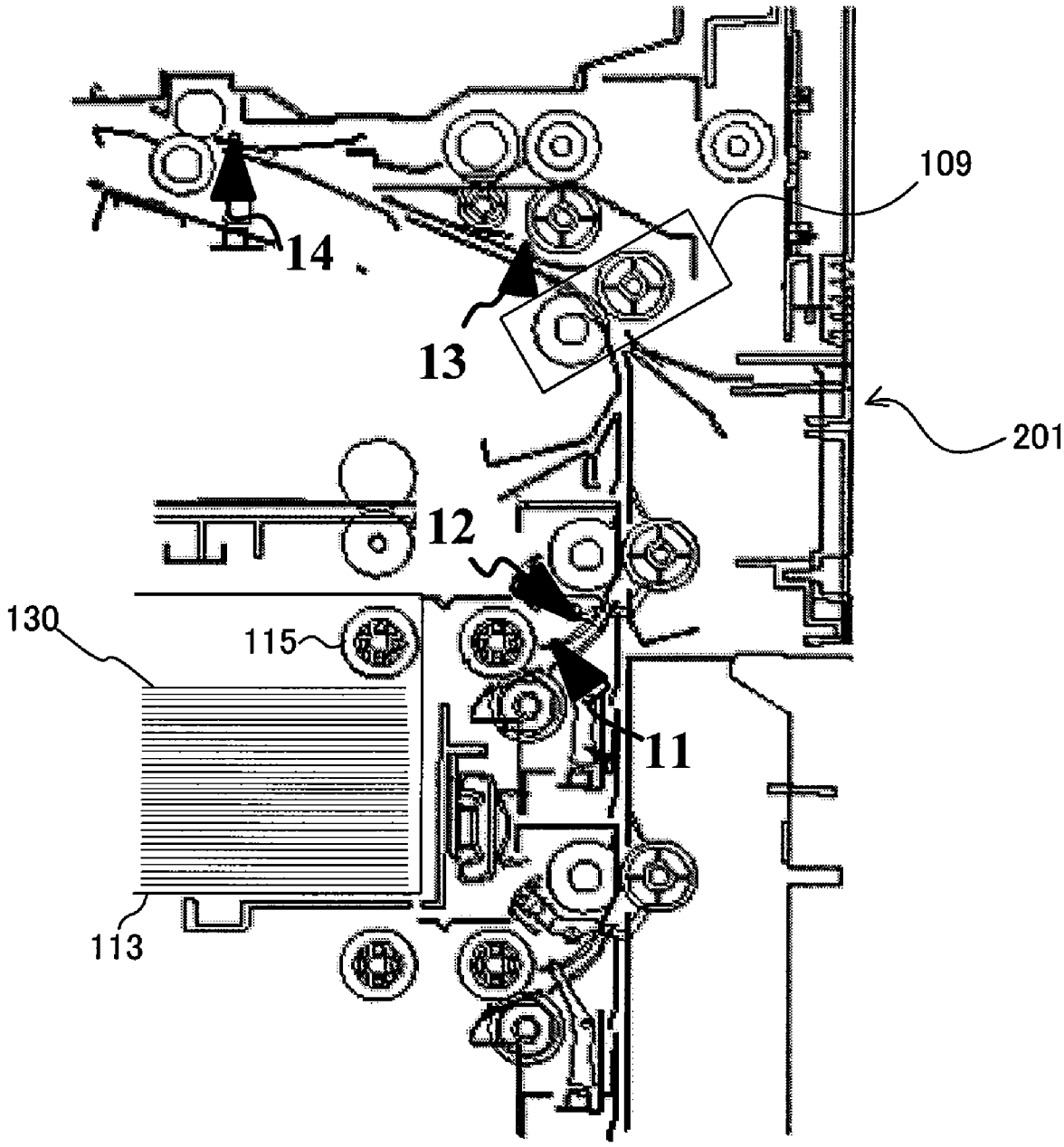
FIG. 2 is a longitudinal sectional view showing a detailed configuration of the vicinity of a paper feeding unit 109 of an image forming apparatus 201 according to the embodiment.

FIG. 2 is a longitudinal sectional view showing a detailed configuration of the vicinity of the paper feeding unit 109 of the image forming apparatus 201 according to this embodiment. In the image forming apparatus 201 according to this embodiment, the sheet 130 is detected by four sensors, that is, a paper feeding sensor 11, a carrying sensor 12, an intermediate carrying sensor 13, and a registration sensor 14, in the vicinity of the paper feeding unit 109.

These four sensors are, for example, optical sensors. When the sensors have detected the forward edge of the sheet 130 carried in the carrying direction, the sensors turn to the ON-state. When the sensors have detected the rear edge of the sheet 130, the sensors turn to the OFF-state.

The control unit 101 determines the time point when each sensor turns to the ON-state, as "ON time", and the time point when each sensor turns to the OFF-state, as "OFF time". Thus, the passage of the sheet 130 over each sensor is detected.

Figure 3:
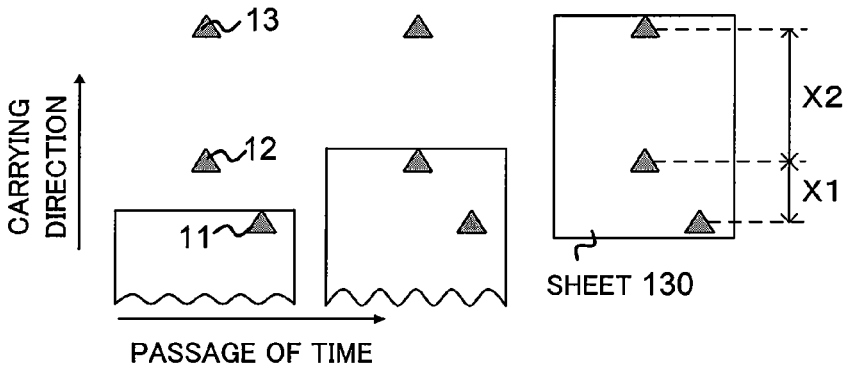
FIG. 3 is a view showing a layout of a paper feeding sensor 11, a carrying sensor 12 and an intermediate carrying sensor 13 with respect to the carrying direction of a sheet 130 in the image forming apparatus 201 according to the embodiment.

FIG. 3 is a view showing a layout of the paper feeding sensor 11, the carrying sensor 12 and the intermediate carrying sensor 13 with respect to the carrying direction of the sheet 130 in the image forming apparatus 201 according to this embodiment.

As can be seen from FIG. 3, the paper feeding sensor 11, the carrying sensor 12 and the intermediate carrying sensor 13 are arranged at different positions from each other in the sheet carrying direction.

The paper feeding sensor 11 and the carrying sensor 12 are arranged at different positions from each other in a direction orthogonal to the carrying direction of the sheet 130. The carrying sensor 12 and the intermediate carrying sensor 13 are arranged at substantially the same positions in the direction orthogonal to the carrying direction of the sheet 130. Of course, their positions are not limited to these. For example, any two of the paper feeding sensor 11, the carrying sensor 12 and the intermediate carrying sensor 13 may be arranged at substantially the same positions in the direction orthogonal to the carrying direction of the sheet 130.

Figure 4:
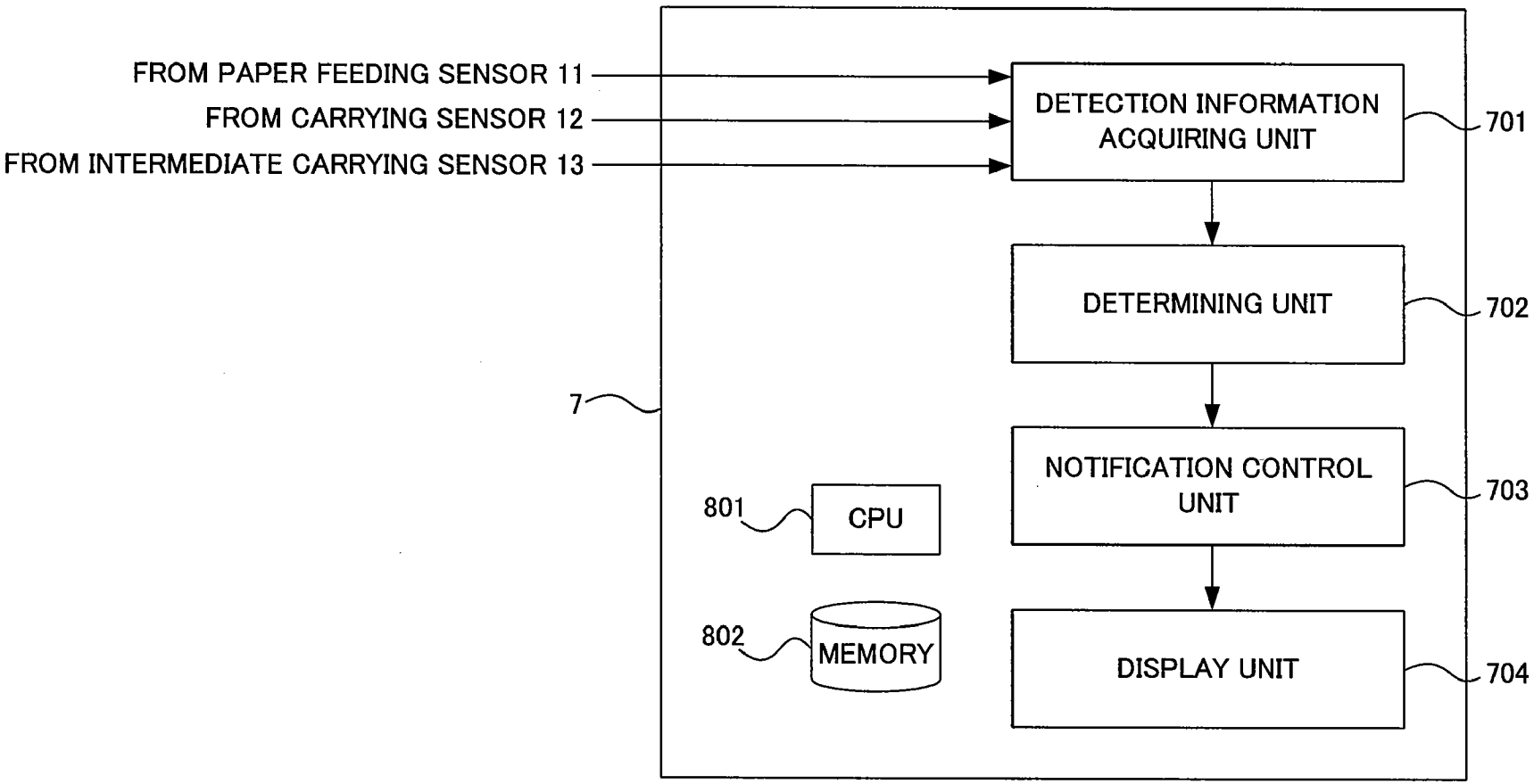
FIG. 4 is a functional block diagram for explaining a sheet carrying state determining device 7 according to the embodiment.

FIG. 4 is a functional block diagram for explaining a sheet carrying state determining device 7 according to this embodiment. The sheet carrying state determining device 7 has a detection information acquiring unit 701, a determining unit 702, a notification control unit 703, a display unit 704, the CPU 801 and the memory 802.

The detection information acquiring unit 701 has the function of acquiring information about sheet detection timing by at least two sensors.

The determining unit 702 has the function of determining a skew of a carried sheet in accordance with the information acquired by the detection information acquiring unit 701. Specifically, the determining unit 702 determines whether the sheet movement time between two sensors each is normal or not, in accordance with the result of comparing the movement time of the sheet between two sensors each and the sheet movement time in a state where the sheet is carried normally between the two sensors, provided from the information acquired from the paper feeding sensor 11, the carrying sensor 12 and the intermediate carrying sensor 13 by the detection information acquiring unit 701. The determining unit 702 then determines the presence or absence of a skew of the sheet in accordance with the combination of normality or abnormality between two sensors each.

Here, the "sheet movement time" refers to the time from when the forward edge of the sheet is detected at the detection position by the sensor situated upstream in the sheet carrying direction (for example, the paper feeding sensor 11) until the forward edge of the sheet is detected at the detection position by the sensor situated downstream in the sheet carrying direction (for example, the carrying sensor 12). Of course, the detection of the sheet to acquire the sheet movement time need not necessarily be carried out by detection of the forward edge of the sheet, and may be carried out by detection of the rear edge of the sheet.

The notification control unit 703 has the function of causing the display unit 704 to give a notification through screen display in the case where the rotation angle of the skew calculated by the determining unit 702 has a predetermined value or more.

The display unit 704 is formed by, for example, a liquid crystal display, CRT display, or EL display. The display unit 704 has the function of showing the information about processing contents in the sheet carrying state determining device 7 or the image forming apparatus 201 through screen display. The display unit 704 may also be realized by, for example, a touch panel display or the like.

The CPU 801 has the function of carrying out various kinds of processing in the sheet carrying state determining device 7 and the image forming apparatus 201. The CPU 801 is also responsible for realizing various functions by executing programs stored in the memory 802. The memory 802 is formed by, for example, a ROM or RAM. The memory 802 has the function of storing various information and programs used in the sheet carrying state determining device 7 and the image forming apparatus 201.

Next, a method of detecting a skew of a sheet according to this embodiment will be described.

Figure 5:
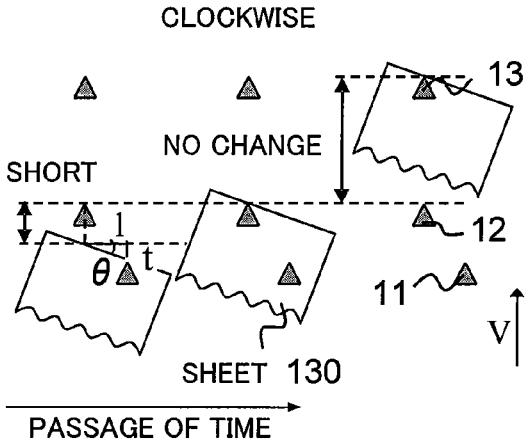
FIG. 5 is a view showing a state where a skew of a sheet has occurred in the sensor layout shown in FIG. 3.
Figure 6:
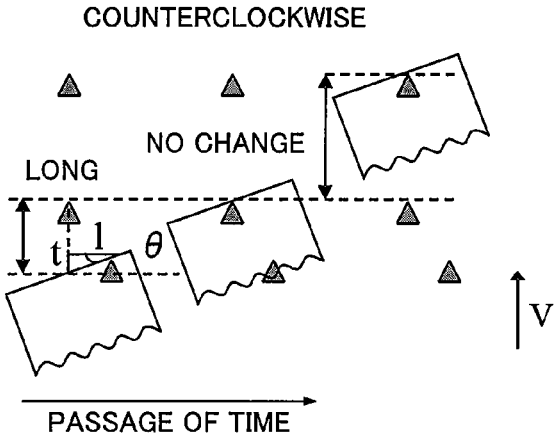
FIG. 6 is a view showing a state where a skew of a sheet has occurred in the sensor layout shown in FIG. 3.

FIG. 5 and FIG. 6 are views showing a state where a skew of a sheet has occurred in the sensor layout shown in FIG. 3. It is now assumed that the carrying speed of the sheet 130 is V, the skew angle is θ, and the distance by which the paper feeding sensor 11 and the carrying sensor 12 are shifted from each other in the direction orthogonal to the sheet carrying direction is l. As the time for the forward edge of the sheet 130 to pass the paper feeding sensor 11 and the carrying sensor 12 is detected, the passage time of the sheet 130 that is skewed clockwise is shorter by $t(l \times \tan\theta \div V)$ than the passage time of the sheet that is normally carried (in the normal state without a skew) (see FIG. 5). Meanwhile, the passage time of the sheet 130 that is skewed counterclockwise is longer by $t(l \times \tan\theta \div V)$ than the passage time of the sheet that is normally carried (see FIG. 6).

Figure 7:
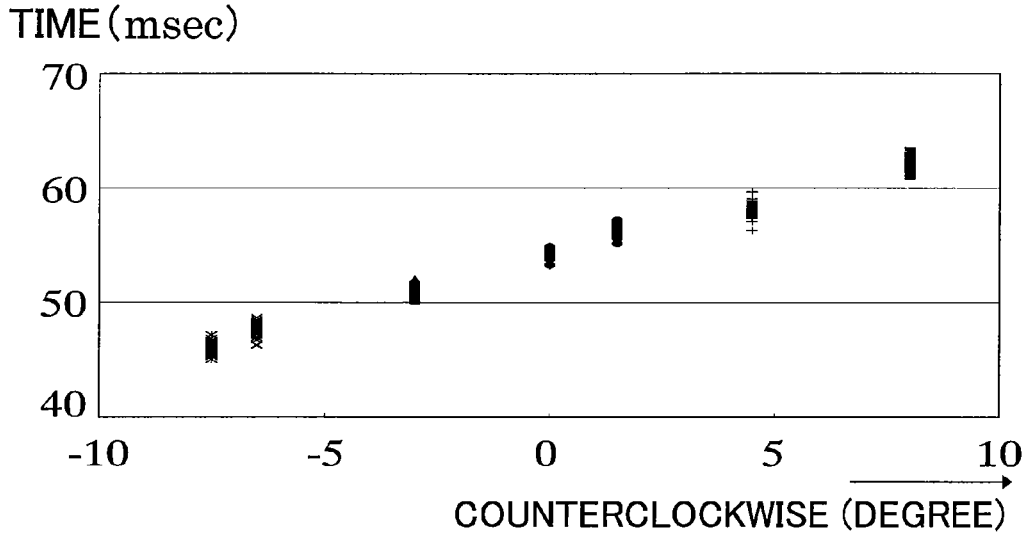
FIG. 7 is a graph showing a state where the carrying time changes in proportion to the skew angle of a carried sheet.
Figure 8:
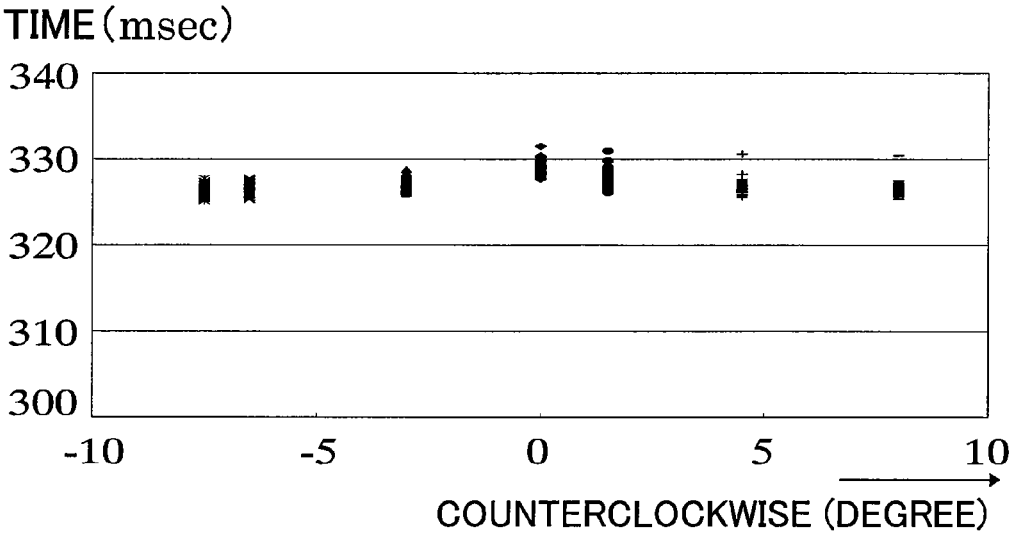
FIG. 8 is a graph showing change in the carrying time with respect to the skew angle of a sheet between sensors that are linearly installed with respect to the carrying direction.

In this manner, between the sensors situated at different positions from each other in the direction orthogonal to the sheet carrying direction, the carrying time changes in proportion to the skew angle of the carried sheet (see FIG. 7). The time for the sheet 130 to pass between the carrying sensor 12 and the intermediate carrying sensor 13 hardly changes irrespective of the presence or absence of a skew. FIG. 8 is a graph showing change in the carrying time with respect to the skew angle of the sheet between the sensors arranged at substantially the same positions in the direction orthogonal to the carrying direction. As can be seen from the graph, the difference due to the skew angle of the sheet is hardly reflected on the carrying time in the section (X2) between the carrying sensor 12 and the intermediate carrying sensor 13 arranged at substantially the same positions in the direction orthogonal to the sheet carrying direction.

Figure 9:
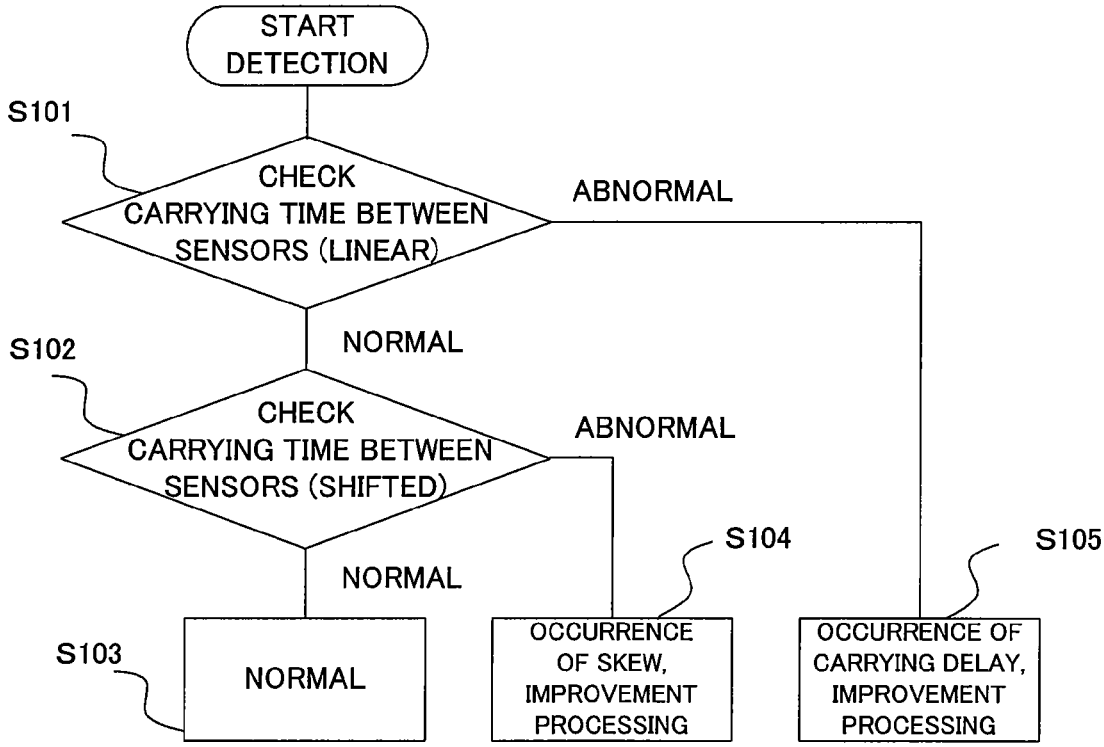
FIG. 9 is a flowchart showing a flow of processing to determine a skew of the sheet 130.

FIG. 9 is a flowchart showing a flow of processing to determine the skew of the sheet 130. "Normal" in FIG. 9 indicates that the sheet 130 is carried in the same manner as in the case where the sheet is carried normally. "Abnormal" indicates that the carrying time of the sheet 130 does not fall within a predetermined range that is expected, compared to the case where the sheet is carried normally.

First, the determining unit 702 determines whether the time for the forward edge (or rear edge) of the sheet 130 to pass the section (X2) between the carrying sensor 12 and the intermediate carrying sensor 13 is normal or not (S101).

If it is determined in S101 that the time is abnormal, it is determined that the carrying time is delayed by other factors than a skew. Therefore, the notification control unit 703 causes the display unit 704 to display a notification to the serviceman on the screen (S105).

On the other hand, if it is determined in S101 that the time is normal, the processing goes to S102. The determining unit 702 determines whether the time for the forward edge (or rear edge) of the sheet 130 to pass the section (X1) between the paper feeding sensor 11 and the carrying sensor 12 is normal or not (S102).

If it is determined in S102 that the time is abnormal, it is determined that the sheet is skewed. Therefore, the display unit 704 shows a screen display (notification) to draw attention (S104).

On the other hand, if it is determined in S102 that the time is normal, it is determined that no error has occurred and that the sheet is carried in the normal state (S103).

The determining unit 702 detects the time for the forward edge (or rear edge) of the sheet 130 to pass the section (X1) between the paper feeding sensor 11 and the carrying sensor 12 and thus can calculate the angle ($\theta = \arctan(t \times V \div 1)$) and direction (clockwise or counterclockwise) in which the sheet 130 is skewed.

In this manner, the determining unit 702 calculates the rotation angle of the skew of the sheet in accordance with the time difference between the sheet movement time between the paper feeding sensor 11 and the carrying sensor 12 (the first section X1) provided from the information acquired by the detection information acquiring unit 701 and the sheet movement time without a skew between the paper feeding sensor 11 and the carrying sensor 12.

In this embodiment, the paper feeding sensor 11 is arranged with a right shift with respect to the carrying sensor 12 in the direction orthogonal to the sheet carrying direction. Therefore, if the sheet movement time between the paper feeding sensor 11 and the carrying sensor 12 provided from the information acquired by the detection information acquiring unit 701 is shorter than the sheet movement time without a skew between the paper feeding sensor 11 and the carrying sensor 12, the determining unit 702 determines that the sheet is skewed to the right (clockwise) with respect to the sheet carrying direction.

As the time for the forward edge (or rear edge) of the sheet 130 to pass between the carrying sensor 12 and the intermediate carrying sensor 13 arrayed linearly with respect to the carrying direction (the second section X2) is detected, it can be determined that the carrying time is delayed by other factors than a skew. By making a determination based on the combination these two kinds of changes in the carrying time, it is possible to detect a skew.

The determining unit 702 determines the skew of the sheet on the basis of the sheet movement time in the first section X1 between the paper feeding sensor 11 and the carrying sensor 12 in the sheet carrying direction, and determines the other factors (wear of a roller or the like) that influence the sheet carrying state than the skew on the basis of the sheet movement time in the second section X2 between the carrying sensor 12 and the intermediate carrying sensor 13.

That is, comparison is made with the carrying time when the sheet is normally carried, to detect the presence or absence of other jam factors than the skew, and determination is based on the combination with the present or absence of change in the carrying time in the case of using the detection method to detect a skew. Thus, the skew and other paper jam factors can be discriminated.

Next, a method of arranging each sensor in this embodiment will be described.

In the above description of the skew detection method, skew detection is carried out by using the second section (X2) between the carrying sensor 12 and the intermediate carrying sensor 13, and the first section (X1) between the paper feeding sensor 11 and the carrying sensor 12. However, a sensor arrangement method that enables skew detection is not limited to this arrangement method.

Figure 10:
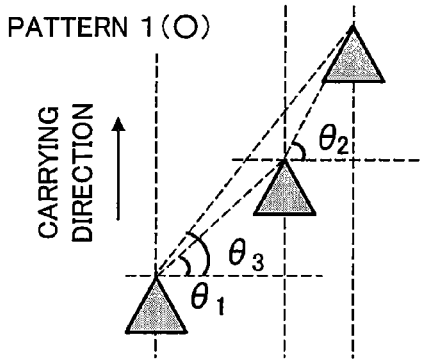
FIG. 10 is a view showing an exemplary sensor layout that enables determination of a skew of a sheet separately from other factors than the skew that influence the sheet carrying state.
Figure 11:
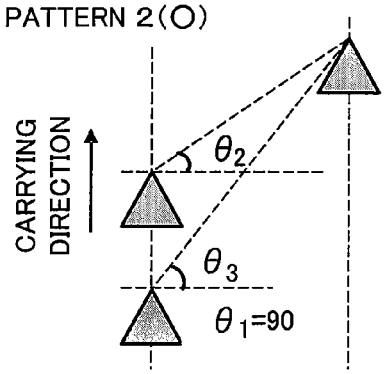
FIG. 11 is a view showing an exemplary sensor layout that enables determination of a skew of a sheet separately from other factors than the skew that influence the sheet carrying state.
Figure 12:
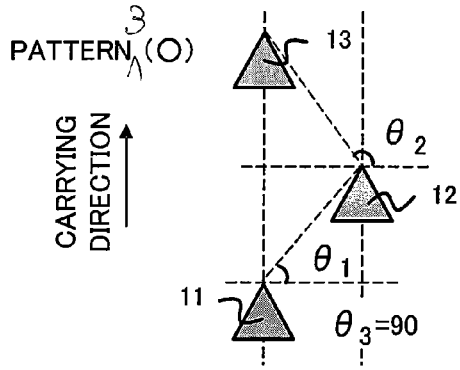
FIG. 12 is a view showing an exemplary sensor layout that enables determination of a skew of a sheet separately from other factors than the skew that influence the sheet carrying state.
Figure 13:
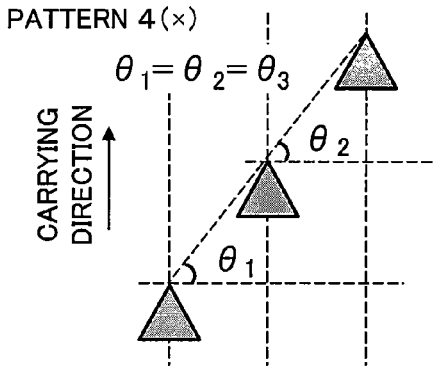
FIG. 13 is a view showing an exemplary sensor layout that does not enable determination of a skew of a sheet separately from other factors than the skew that influence the sheet carrying state.

FIG. 10 to FIG. 13 are views showing exemplary sensor layouts that enable detection of the skew of a sheet. In the sensor layouts as shown in FIG. 10 to FIG. 12, "a skew of the carried sheet" and "a change in the carrying time due to wear of a roller or the like" can be separated and the skew can be detected more accurately. However, in FIG. 13, "a skew of the carried sheet" and "a change in the carrying time due to wear of a roller or the like" cannot be separated and the skew cannot be detected more accurately. Here, if the inclination of a straight line that connects the paper feeding sensor 11 to the carrying sensor 12 with respect to the direction orthogonal to the sheet carrying direction (hereinafter simply referred to as inclination) is $\theta 1$, the inclination of a straight line that connects the carrying sensor 12 to the intermediate carrying sensor 13 is $\theta 2$, and the inclination of a straight line that connects the paper feeding sensor 11 to the intermediate carrying sensor 13 is $\theta 3$, changes in the carrying time due to a skew and due to other factors than a skew can be separately detected when a sensor layout that holds $\theta 1 \neq \theta 2$ (pattern 1, pattern 2, and pattern 3) is employed.

However, when a sensor layout that holds $\theta 1 = \theta 2$ (pattern 4) is employed, changes in the carrying time due to a skew and due to other factors than a skew cannot be separately detected. This is because, when a skew has occurred, no change is observed in the difference in the time for the forward edge (or rear edge) of the sheet 130 to pass between the paper feeding sensor 11 and the carrying sensor 12 from the normal state and the difference in the time for the forward edge (or rear edge) of the sheet 130 to pass between the carrying sensor 12 and the intermediate carrying sensor 13 from the normal state.

As can be understood from the above, it is preferable that the straight line connecting the first sensor to the second sensor of the three sensors and the straight line connecting at least one of the first sensor and the second sensor to the third sensor have different inclination angles with respect to the sheet carrying direction.

To detect the difference in the carrying time of one msec for the skew angle of the sheet of one degree compared to the case where the sheet is normally carried, it is preferable that, when the sheet carrying speed is V mm/sec, two sensors arranged at positions shifted from each other in the direction orthogonal to the sheet carrying direction (for example, the paper feeding sensor 11 and the carrying sensor 12) are installed in such a manner that their positional shift is $0.0573 \times V$ mm or more.

Next, the case of detecting a skew that occurs at the time of feeding a sheet will be described.

Figure 14:
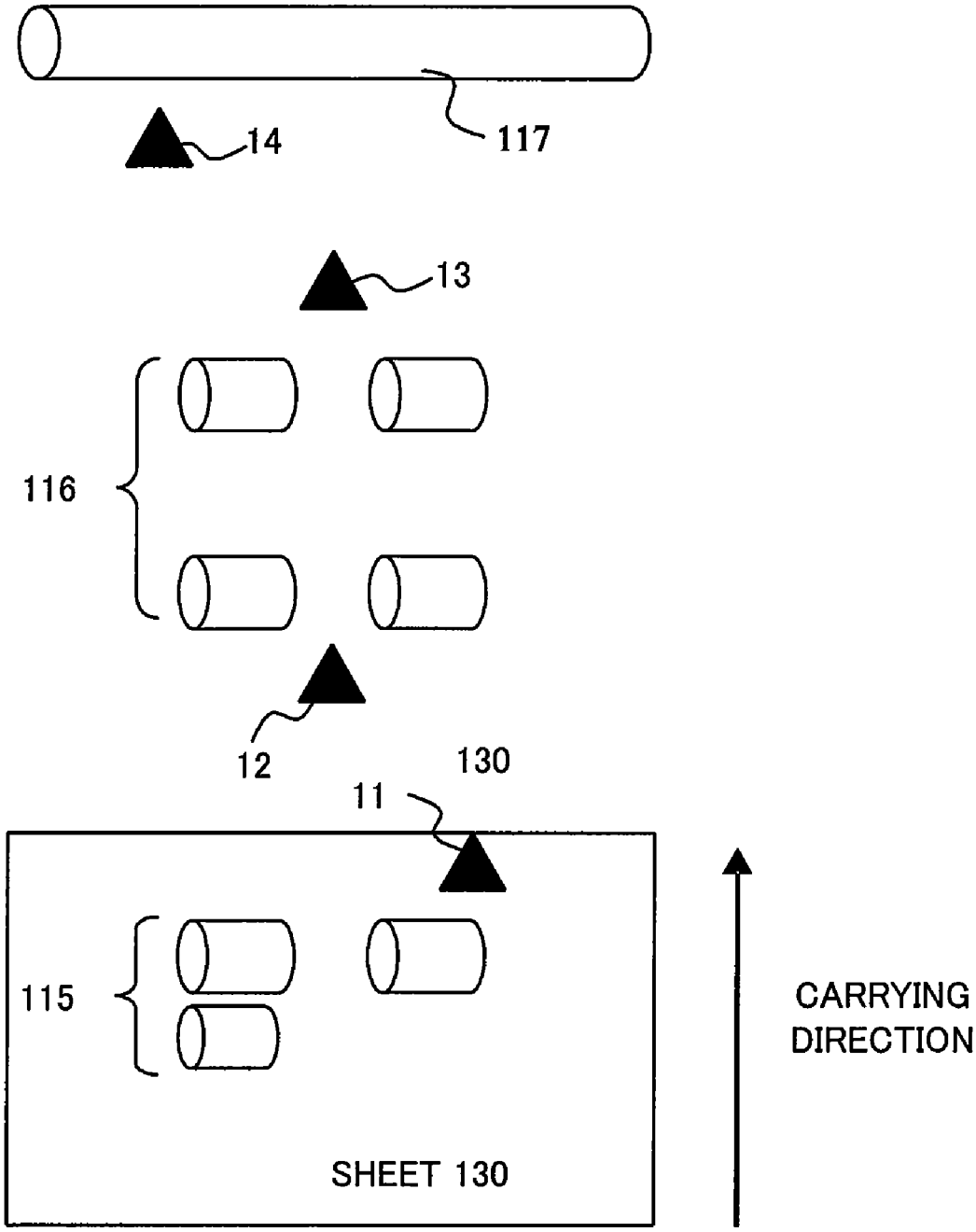
FIG. 14 is a view showing a layout of each sensor and roller in the sheet carrying direction.

FIG. 14 is a view showing a layout of each sensor and roller in the sheet carrying direction. The paper feeding sensor 11 and the carrying sensor 12 are installed in the vicinity of the downstream side of the paper feeding rollers 115. Carrying rollers 116 and the intermediate carrying sensor 13 are installed downstream of the carrying sensor 12. The paper feeding sensor 11 and the carrying sensor 12 are arranged at positions shifted from each other in the direction orthogonal to the sheet carrying direction. The carrying sensor 12 and the intermediate carrying sensor 13 are arranged at substantially the same positions in the direction orthogonal to the sheet carrying direction.

Thus, according to the above skew detection method, in the case where the sheet has been skewed in the paper feeding unit 109, the time for the forward edge (or rear edge) of the sheet 130 to pass between the paper feeding sensor 11 and the carrying sensor 12 increases or decreases compared to the normal state, whereas the time for the forward edge (or rear edge) of the sheet 130 to pass between the carrying sensor 12 and the intermediate carrying sensor 13 does not change compared to the normal state.

Figure 15:
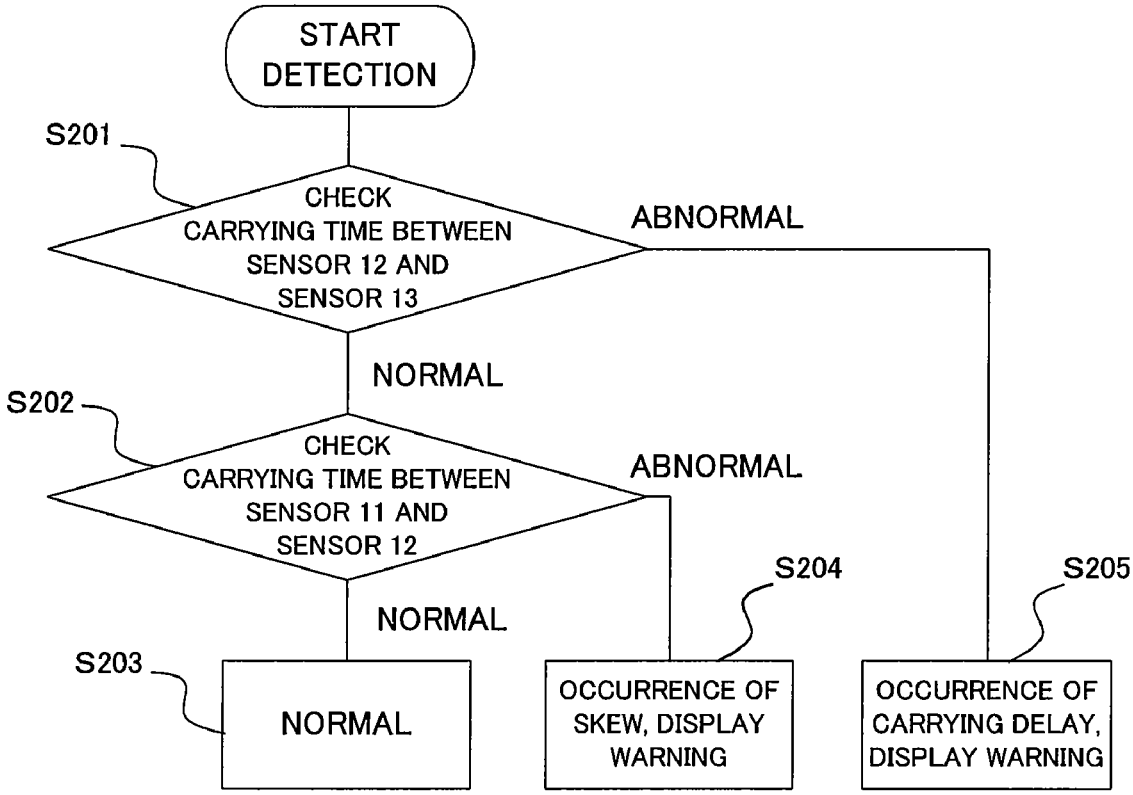
FIG. 15 is a flowchart showing a flow of skew detection processing in the case where the sensor layout shown in FIG. 14 is employed.

In the case where the sheet carrying time is changed by wear of a roller or the like in the sheet carrying path, the carrying time changes in both the section between the paper feeding sensor 11 and the carrying sensor 12 and the section between the carrying sensor 12 and the intermediate carrying sensor 13. Therefore, with the configuration of FIG. 14, even if the sheet is skewed when the sheet is supplied, the skew at the time of sheet supply can be detected and measures can be taken such as causing the display unit 704 to display a warning related to the carrying state. FIG. 15 is a flowchart showing a flow of skew detection processing (S201 to S205) in the case where the sensor layout shown in FIG. 14 is employed. The steps in the flowchart shown in FIG. 15 are of the processing similar to the steps in the flowchart shown in FIG. 9 and therefore will not be described further in detail.

Next, the case of detecting a skew occurring upstream of a registration roller 117 that caries out skew correction and adjustment of carrying timing of the carried sheet will be described.

As shown in FIG. 14, the intermediate carrying sensor 13 and the registration sensor 14 are installed in the vicinity of the upstream side of the registration roller 117. As can be seen from FIG. 14, the intermediate carrying sensor 13 and the registration sensor 14 are arranged with a shift so that these sensors are situated at different positions in the direction orthogonal to the sheet carrying direction. Thus, in the case where the skew detection method as described above is used, if the sheet is skewed immediately before the registration roller 117, the time for the forward edge (or rear edge) of the sheet 130 to pass between the intermediate carrying sensor 13 and the registration sensor 14 increases or decreases compared to the normal state, whereas the time for the forward edge (or rear edge) of the sheet 130 between the carrying sensor 12 and the intermediate carrying sensor 13 does not change compared to the normal state.

In the case where the sheet carrying time is changed by wear of a roller or the like, the carrying time changes in the two carrying sections between the intermediate carrying sensor 13 and the registration sensor 14 and between the carrying sensor 12 and the intermediate carrying sensor 13. Therefore, with the configuration of FIG. 14, even if the sheet is skewed immediately before the registration roller 117, the skew that is immediately before the registration roller 117 can be detected and measures can be taken such as causing the display unit 704 to display a warning related to the carrying state of the sheet.

Figure 16:
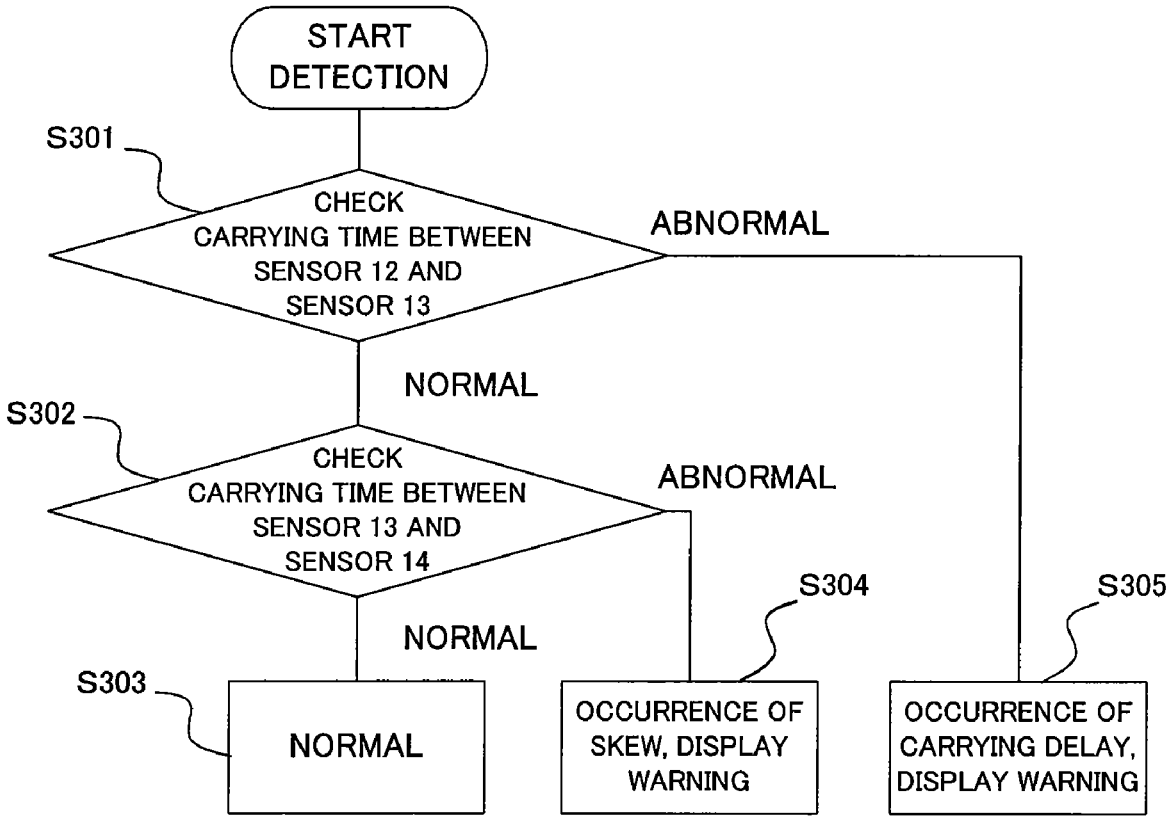
FIG. 16 is a flowchart showing a flow of skew detection processing in the case where the sensor layout shown in FIG. 14 is employed.

FIG. 16 is a flowchart showing a flow of skew detection processing (S301 to S305) in the case where the sensor layout shown in FIG. 14 is employed. As in FIG. 15, the steps in the flowchart shown in FIG. 16 are of the processing similar to the steps in the flowchart shown in FIG. 9 and therefore will not be described further in detail.

Now, the case of detecting a skew generated in a sheet on which image forming processing has been carried out will be described.

Figure 17:
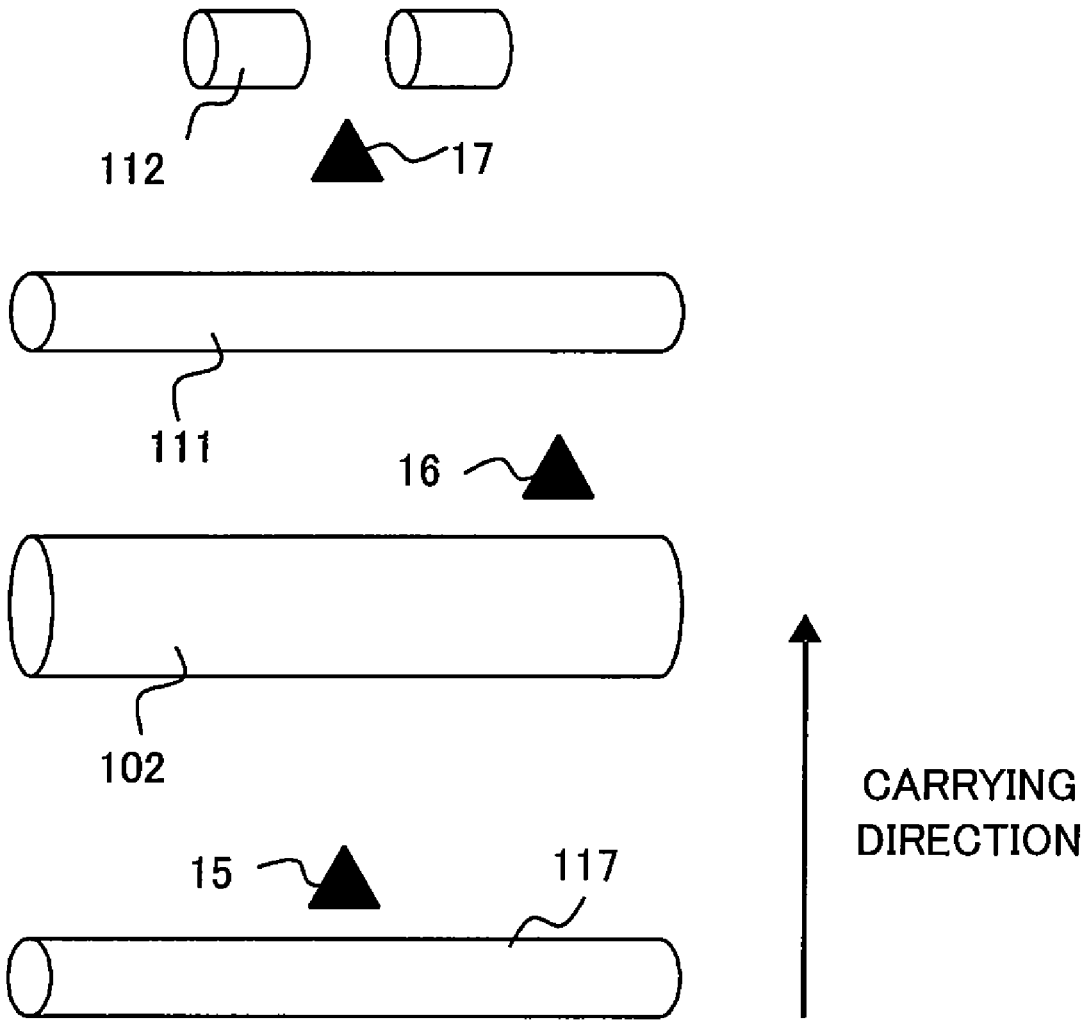
FIG. 17 is a view showing a layout of sensors and rollers in the vicinity of the downstream side of a registration roller 117.
Figure 18:
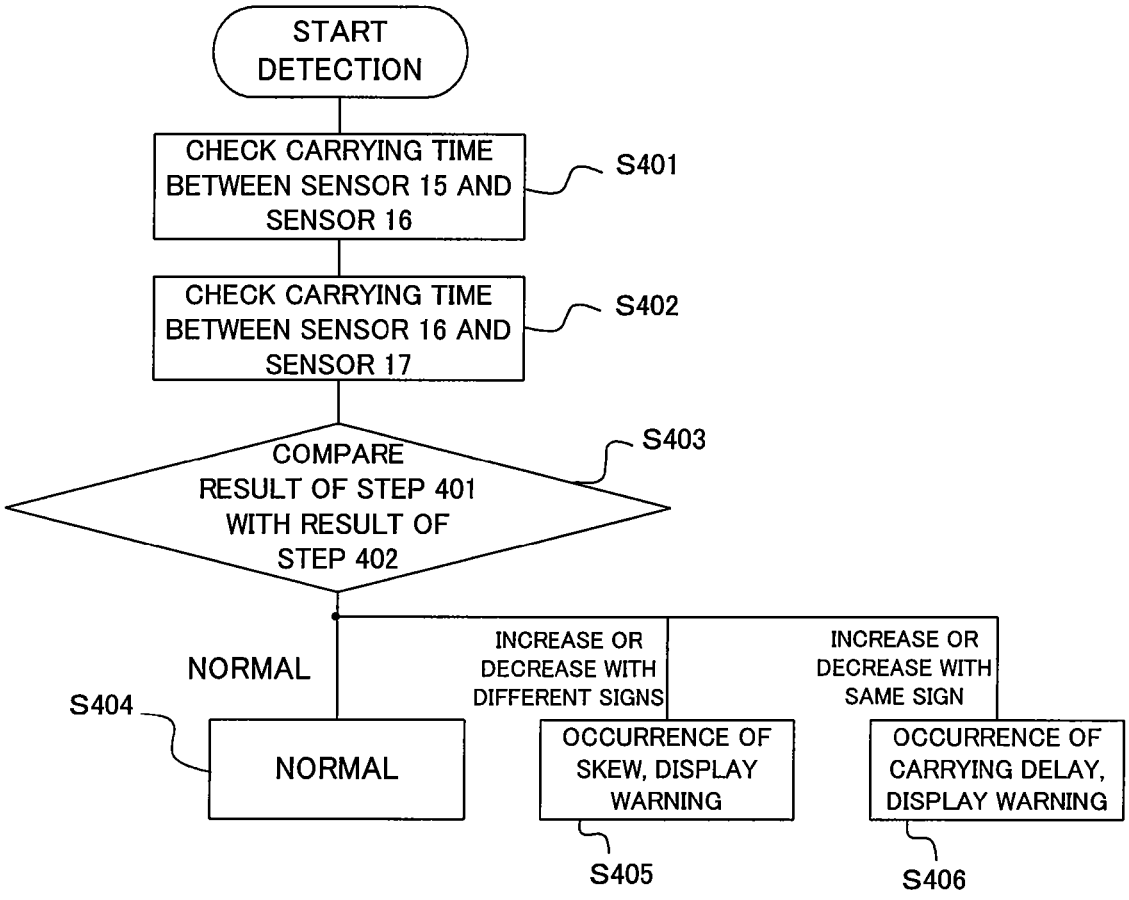
FIG. 18 is a flowchart showing a flow of skew detection processing in the case where the sensor layout shown in FIG. 17 is employed.
Figure 19:
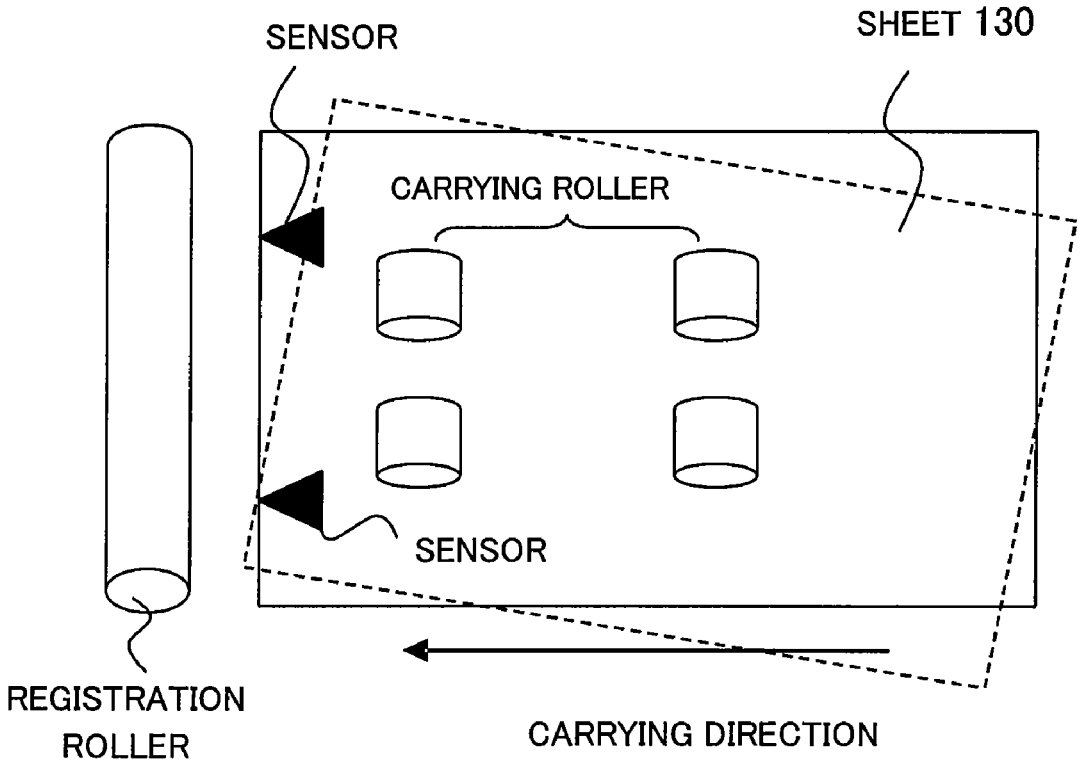
FIG. 19 is a view for explaining a conventional sensor layout.

FIG. 17 is a view showing a layout of sensors and rollers in the vicinity of the downstream side of the registration roller 117. FIG. 18 is a flowchart showing a flow of skew detection processing (S401 to S406) in the case where the sensor layout shown in FIG. 17 is employed.

In the configuration shown in FIG. 17, a pre-transfer sensor 15, a winding sensor 16 and a paper discharge sensor 17 are arranged downstream of the registration roller 117 in the sheet carrying direction. As shown in FIG. 17, the pre-transfer sensor 15 and the winding sensor 16 are arranged with a shift from each other in the direction orthogonal to the sheet carrying direction (to the right with respect to the carrying direction). The winding sensor 16 and the paper discharge sensor 17 are arranged with a shift from each other in the direction orthogonal to the sheet carrying direction (to the left with respect to the carrying direction).

Thus, with the skew detection method as described above, if the sheet is skewed at the time of printing, the time for the forward edge (or rear edge) of the sheet 130 to pass between the pre-transfer sensor 15 and the winding sensor 16 (S401) and the time for the forward edge (or rear edge) of the sheet 130 to pass between the winding sensor 16 and the paper discharge sensor 17 (S402) increase or decrease compared to the normal state.

However, if the passage time between the pre-transfer sensor 15 and the winding sensor 16 increases compared to the normal state (S403), the passage time between the winding sensor 16 and the paper discharge sensor 17 decreases compared to the normal state, and vice versa.

In the case where the carrying time is changed by wear of a roller or the like, the carrying time similarly changes in the two carrying sections between the pre-transfer sensor 15 and the winding sensor 16 and between the winding sensor 16 and the paper discharge sensor 17.

Thus, even if the sheet is skewed at the time of printing, the skew at the time of printing can be detected and measures can be taken such as causing the display unit 704 or a control panel or the like, not shown, provided in the image forming apparatus 201, to display a warning related to the sheet carrying state (S405, S406).

The steps of the above processing in the sheet carrying state determining device are realized as the CPU 801 executes a sheet carrying state determination program stored in the memory 802.

The sheet to be a carrying target in the above embodiment may be, for example, a copy sheet (normal paper). The sheet is not limited to this. As a matter of course, an OHP film, a coated sheet, a thick paper or the like as a printing medium can be employed.

Moreover, as a matter of course, the image forming apparatus 201 according to the above embodiment not only carries out image forming processing on a sheet, but also may have an image scanning device and a communication function and have the functions of a digital multi-function peripheral including scanning, reading and copying an image with designated resolution and sheet size, receiving an image by FAX or e-mail, and receiving a printed image through a network.

In the above embodiment, it is assumed that a sheet is carried within the image forming apparatus. However, it does not necessarily have to be an image forming apparatus. An apparatus that carries a sheet and has plural sensors for detecting the sheet as a carrying target (for example, an automatic document feeder (ADF) or the like) can achieve the similar advantages to those of the embodiment.

As described above, according to the embodiment, a skew of a sheet can be detected by using sensors arranged in a typical layout, without increasing the number of sensors over the number of sensors that are normally arranged in the sheet carrying device.

In a sensor layout having at least two sensor sections where the inclination between two sensors with respect to the sheet carrying direction is different from each other, the carrying time in each sensor section is compared to the carrying time at the time of normal carrying in the same section, and the results of the comparison of the two or more sensor section are combined for determination. Thus, other paper jam factors and a skew can be separately determined.

Moreover, since the paper detection sensors are used, the quantity of skew can be detected irrespective of sheet size and this can contribute to improvement in the degree of freedom in the sensor layout and the degree of freedom in design.

In the embodiment, the functions that carry out the invention have been recorded in the apparatus in advance. However, the configuration of the functions is not limited to this. The similar functions may be downloaded to the apparatus from a network. Alternatively, the similar functions stored in a recording medium may be installed into the apparatus. The recording medium may be in any form as long as it can store programs and is readable by the apparatus, for example, a CD-ROM or the like. The functions that are installed or downloaded in advance may be realized in cooperation with the operating system (OS) in the apparatus.

Although the specific embodiment of the invention has been described in detail, it would be obvious to those skilled in the art that various changes and modifications can be made without departing from the spirit and scope of the invention.

As described above in detail, according to the invention, a technique can be provided that enables detection of the state of a sheet skew or the like without adding a special sensor or the like in the sheet carrying apparatus if possible.

What is claimed is:

1. A sheet carrying state determining device comprising:

a detection information acquiring unit configured to acquire information about sheet detection timing by two sensors that are arranged at positions different from each other in a sheet carrying direction and arranged at positions different from each other in a direction orthogonal to the sheet carrying direction;

a control unit configured to determine a skew of a carried sheet in addition to performing sheet detection in accordance with the information acquired by the detection information acquiring unit; and a third sensor arranged at a position that is connected with at least one of the two sensors by a straight line having a different inclination angle from a straight line connecting the two sensors with respect to the sheet carrying direction, the detection information acquiring unit being further configured to acquire information about sheet detection timing by the third sensor, and in accordance with a sheet movement time in a first section between the two sensors in the sheet carrying direction and in a second section between one of the two sensors and the third sensor, the control unit being further configured to combine results of determination of the sheet movement time in the two sections and thereby determine a skew of the sheet separately from another factor than a skew that influences the sheet carrying state.

2. The sheet carrying state determining device according to claim 1, wherein the control unit determines the presence or absence of a skew of the sheet in accordance with a result of comparison of a sheet movement time between the two sensors provided from the information acquired by the detection information acquiring unit with a movement time of the sheet without a skew between the two sensors.

3. The sheet carrying state determining device according to claim 2, wherein in the case where a sensor situated upstream in the sheet carrying direction, of the two sensors, is arranged with a shift toward one side in a direction orthogonal to the sheet carrying direction with respect to a sensor situated downstream in the sheet carrying direction, of the two sensors, if the sheet movement time between the two sensors provided from the information acquired by the detection information acquiring unit is shorter than the movement time of the sheet without a skew between the two sensors, the control unit determines that the sheet is inclined toward the one side with respect to the sheet carrying direction, and if the former sheet movement time is longer, the control unit determines that the sheet is inclined toward the opposite side to the one side.

4. The sheet carrying state determining device according to claim 1, wherein the third sensor and one of the two sensors are arranged at substantially the same positions in a direction orthogonal to the sheet carrying direction.

5. The sheet carrying state determining device according to claim 1, wherein when the sheet carrying speed is V mm/sec, a position shift between the two sensors in a direction orthogonal to the sheet carrying direction is 0.0573×V mm or more.

6. The sheet carrying state determining device according to claim 1, wherein the two sensors are arranged in the vicinity of an upstream side or a downstream side of a registration roller that corrects a skew of a carried sheet.

7. The sheet carrying state determining device according to claim 1, wherein the two sensors are arranged in the vicinity of a downstream side of a sheet supply roller that supplies a sheet into a sheet carrying path.

8. The sheet carrying state determining device according to claim 2, wherein the control unit calculates a rotation angle of the skew of the sheet in accordance with a time difference between the sheet movement time between the two sensors provided from the information acquired by the detection information acquiring unit and the movement time of the sheet without a skew between the two sensors, and the apparatus further comprises a notification control unit configured to give a notification if the rotation angle of the skew calculated by the control unit has a predetermined value or more.

9. A sheet carrying state determining method comprising:

acquiring information about sheet detection timing by two sensors that are arranged at positions different from each other in a sheet carrying direction and arranged at positions different from each other in a direction orthogonal to the sheet carrying direction;

determining a skew of a carried sheet and performing sheet detection in accordance with the acquired information; and in accordance with a sheet movement time in a first section between the two sensors in the sheet carrying direction and in a second section between one of the two sensors and a third sensor arranged at a position that is connected with at least one of the two sensors by a straight line having a different inclination angle from a straight line connecting the two sensors with respect to the sheet carrying direction, combining the results of determination of the sheet movement time in the two sections to determine a skew of the sheet separately from another factor than a skew that influences the sheet carrying state.

10. The sheet carrying state determining method according to claim 9, wherein the presence or absence of a skew of the sheet is determined in accordance with a result of comparison of a sheet movement time between the two sensors provided from the acquired information with a movement time of the sheet without a skew between the two sensors.

11. The sheet carrying state determining method according to claim 10, wherein in the case where a sensor situated upstream in the sheet carrying direction, of the two sensors, is arranged with a shift toward one side in a direction orthogonal to the sheet carrying direction with respect to a sensor situated downstream in the sheet carrying direction, of the two sensors, if the sheet movement time between the two sensors provided from the acquired information is shorter than the movement time of the sheet without a skew between the two sensors, it is determined that the sheet is inclined toward the one side with respect to the sheet carrying direction, and if the former sheet movement time is longer, it is determined that the sheet is inclined toward the opposite side to the one side.

12. The sheet carrying state determining method according to claim 9, wherein the third sensor and one of the two sensors are arranged at substantially the same positions in a direction orthogonal to the sheet carrying direction.

13. The sheet carrying state determining method according to claim 9, wherein when the sheet carrying speed is V mm/sec, a position shift between the two sensors in a direction orthogonal to the sheet carrying direction is 0.0573×V mm or more.

14. The sheet carrying state determining method according to claim 9, wherein the two sensors are arranged in the vicinity of an upstream side of a registration roller that corrects a skew of a carried sheet.

15. The sheet carrying state determining method according to claim 9, wherein the two sensors are arranged in the vicinity of a downstream side of a sheet supply roller that supplies a sheet into a sheet carrying path.

16. The sheet carrying state determining method according to claim 9, wherein the two sensors are arranged in the vicinity of a downstream side of a registration roller that corrects a skew of a carried sheet.

17. The sheet carrying state determining method according to claim 10, wherein a rotation angle of the skew of the sheet is calculated in accordance with a time difference between the sheet movement time between the two sensors provided from the acquired information and the movement time of the sheet without a skew between the two sensors, and a notification is given if the calculated rotation angle of the skew has a predetermined value or more.

18. A sheet carrying state determining device comprising:

a first sensor;

a second sensor arranged at a position different from the first sensor in a sheet carrying direction and arranged at a position different from the first sensor in a direction orthogonal to the sheet carrying direction;

a third sensor arranged at a position that is connected with at least one of the first sensor and the second sensor by a straight line having a different inclination angle from a straight line connecting the first sensor and the second sensor with respect to the sheet carrying direction; and a controller configured to perform sheet detection using the first sensor, the second sensor and the third sensor and to determine a skew of a carried sheet separately from another factor than skew that influences the sheet carrying state by combining results of determination of sheet movement time in a first section between the first sensor and the second sensor in the sheet carrying direction and in a second section between the third sensor and one of the first sensor and the second sensor.

* * * * *